US008124900B2

(12) United States Patent
Ruppert

(10) Patent No.: US 8,124,900 B2
(45) Date of Patent: Feb. 28, 2012

(54) PUSHBUTTON FOR A HEARING DEVICE

(75) Inventor: Josef Ruppert, Kleinsendelbach (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 380 days.

(21) Appl. No.: 12/386,833

(22) Filed: Apr. 23, 2009

(65) Prior Publication Data

US 2009/0266690 A1 Oct. 29, 2009

(30) Foreign Application Priority Data

Apr. 25, 2008 (DE) ..... 10 2008 020 926

(51) Int. Cl.
*H01H 13/00* (2006.01)
*H01H 13/50* (2006.01)

(52) U.S. Cl. ..... 200/345; 200/341

(58) Field of Classification Search ..... 200/520, 200/302.1, 302.2, 329–333, 341–345; 381/312, 381/322, 123; 400/490–496
See application file for complete search history.

(56) References Cited

U.S. PATENT DOCUMENTS

| | | | | |
|---|---|---|---|---|
| 4,845,325 | A * | 7/1989 | Burchett et al. | 200/302.2 |
| 4,939,324 | A * | 7/1990 | English et al. | 200/345 |
| 5,032,698 | A * | 7/1991 | Satoh | 200/341 |
| 5,343,006 | A * | 8/1994 | Moffett | 200/296 |
| 5,365,593 | A * | 11/1994 | Greenwood et al. | 381/322 |
| 5,938,009 | A * | 8/1999 | Huang | 200/517 |
| 6,091,831 | A * | 7/2000 | Cho | 381/365 |
| 6,171,003 | B1 * | 1/2001 | Lo | 400/495 |
| 6,630,639 | B2 * | 10/2003 | McSwiggen | 200/52 R |
| 6,743,993 | B1 * | 6/2004 | Clark et al. | 200/314 |
| 7,420,136 | B2 * | 9/2008 | Goetzl et al. | 200/341 |
| 2008/0187157 | A1 * | 8/2008 | Higgins | 381/314 |

FOREIGN PATENT DOCUMENTS

| | | |
|---|---|---|
| DE | 10 2005 037 897 B3 | 4/2007 |
| DE | 10 2006 035 090 A1 | 1/2008 |

* cited by examiner

*Primary Examiner* — Michael Friedhofer

(57) ABSTRACT

A pushbutton for a hearing device is provided. The pushbutton includes a probe guided into a housing shell and includes a locking element. The locking element produces a first snap-on connection between the housing shell and the probe when inserted into the probe. As a result, the pushbutton is fixedly connected to the housing shell, as a result of which the housing shell can be easily exchanged.

16 Claims, 4 Drawing Sheets

PUSHBUTTON FOR A HEARING DEVICE

CROSS REFERENCE TO RELATED APPLICATIONS

This application claims priority of German application No. 10 2008 020 926.0 filed Apr. 25, 2008, which is incorporated by reference herein in its entirety.

FIELD OF INVENTION

The invention relates to a pushbutton for a hearing device having a probe and a locking element.

BACKGROUND OF INVENTION

Hearing devices are wearable hearing apparatuses which are used to assist the hard-of-hearing. In order to accommodate numerous individual requirements, various types of hearing devices are available such as behind-the-ear hearing devices, hearing device with external receiver and in-the-ear hearing devices, for example also concha hearing devices or canal hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit.

This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is if necessary transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1. The hearing device is switched on and off with the pushbutton 6.

A behind-the-ear hearing device is shown in FIG. 2, to the frame 7 of which only a housing upper part 8 of the hearing device housing and not the lower housing upper part is shown as attached. Numerous electronic components 9 are incorporated in the frame 7. A battery compartment 10 is also mounted to the frame in a pivotable fashion. The battery compartment 10 accommodates a battery 5 in the form of a button cell. The pushbutton 6, which is arranged in the housing upper part 8, switches the hearing device on and off.

As a result of the miniaturization of behind-the-ear hearing devices, it is necessary to reduce the space requirement of the pushbutton without impairing the operating characteristics.

DE 10 2005 037 897 B3 discloses a covering facility for a program selector switch of a hearing device, with the covering facility with a locking element being locked in a covered state with the hearing device housing.

DE 10 2006 035 090 A1 specifies a control element, which is fastened in an opening of a housing element of a hearing device system by means of a snap-on connection.

SUMMARY OF INVENTION

It is the object of the invention to specify a pushbutton, which has a minimal space requirement, can be switched to be perceptible and allows the housing shell of the hearing device housing to be easily exchanged.

According to the invention, the set object is achieved with the pushbutton for a hearing device of the independent claims.

In accordance with the invention, the pushbutton includes a probe guided into an opening of a housing shell and a locking element. The locking element produces a first snap-on connection between the housing shell and the probe during insertion into a cavity of the probe. The advantage here is that the probe can be fixedly mounted on the housing shell and the housing shell can as a result be exchanged very easily.

The probe may also have a large surface despite the small installation size of the hearing device.

In one development, the locking element with the probe can produce a second snap-on connection. As a result, the locking element is fixedly connected to the probe.

In a further embodiment, the first snap-on connection can be formed by at least one snap-on hook on the probe. The locking element may be embodied such that it locks the snap-on hook on the housing shell. This is advantageous in terms of simple assembly and disassembly.

The second snap-on connection can be advantageously formed by at least one bulge on the locking element. As a result, the second snap-on connection can be produced easily.

In a further embodiment, the probe can comprise a downwardly open cavity. The locking element can be inserted into the cavity. The advantage here is that the first snap-on connection can be easily effected as a result.

In a further embodiment, the housing shell can comprise at least one recess or at least one undercut. The snap-on hook can engage therein. This is advantageous in terms of a durable and reliable snap-on connection.

At least one button can also be arranged below the locking element in the hearing device. When pressing in the probe, the locking element actuates the button. This then allows the hearing device to be switched on or off for instance.

In a further advantageous embodiment, the button can be moved counter to a force, with a switching stage being tactually feelable when the probe is pressed in. This is advantageous in that a hearing device user can easily identify a switching stage.

In one development, a behind-the-ear hearing device can be equipped with at least one push button according to the invention. Small behind-the-ear hearing devices can as a result also be equipped with large-surface pushbuttons.

The button can be advantageously fastened to a frame of the hearing device.

BRIEF DESCRIPTION OF THE DRAWINGS

Further features and advantages of the invention are apparent from the following explanations of several exemplary embodiments with reference to schematic drawings, in which.

DETAILED DESCRIPTION OF INVENTION

Figure 1:
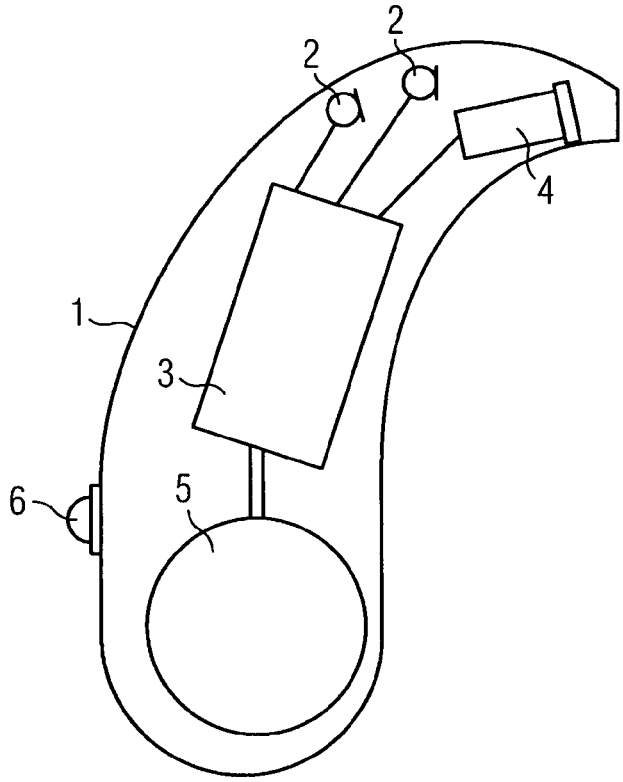
FIG 1 (Prior art)
FIG. 1: shows a schematic diagram of a behind-the-ear hearing device according to the prior art.
Figure 2:
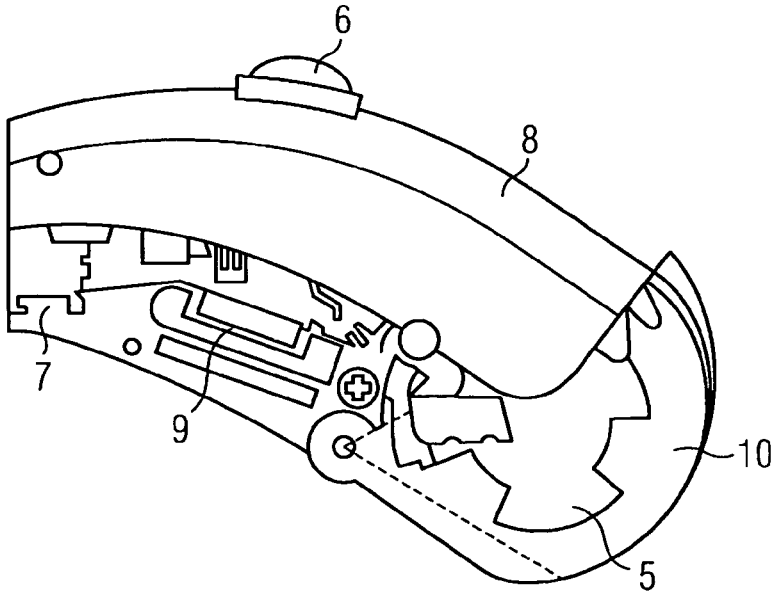
FIG 2 (Prior art)
FIG. 2: shows a detailed view of a behind-the-ear hearing device according to the prior art.
Figure 3:
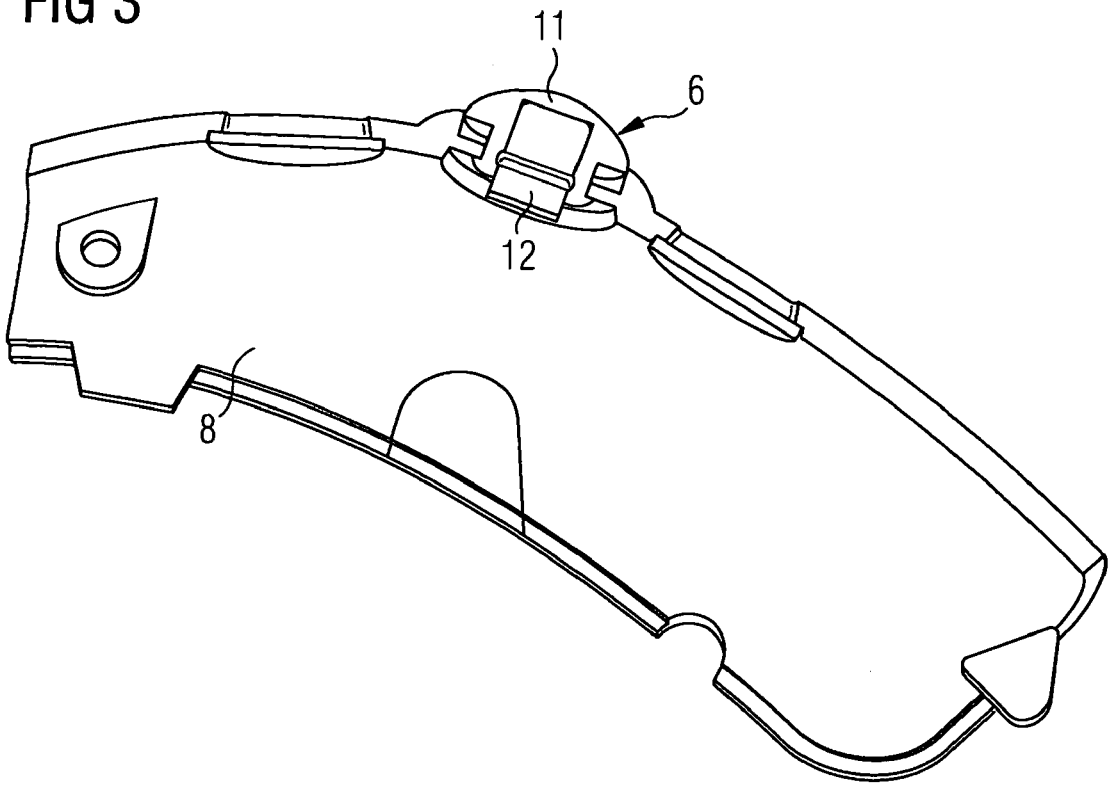
FIG. 3: shows a sectional view of a housing shell with a pushbutton.

FIG. 3 shows a sectional view of an upper housing shell 8 of a behind-the-ear hearing device. A pushbutton 6 is attached to the upper part of the housing shell 8. The pushbutton 6 includes a probe 11 and a locking element 12. The locking element 12 is inserted into the probe 11 and as a result forms a snap-on connection between the probe 11 and the housing shell 8.

Snap-on connections are form-fit connections with numerous design possibilities. The common element to all snap-on connections is that a protruding area of a part, e.g. a hook or a bulge, is briefly moved during assembly and engages in a recess and/or undercut of a connecting partner. The connection is detachable or non-detachable depending on the design of the connecting partner. In the unloaded state, the snap-on connection is only subject to minimal voltages. It is thus generally not tight. Sealing elements are needed for tight connections. As a result of the simple assembly, the snap-on connection is one of the most cost-effective connection possibilities.

Figure 4:
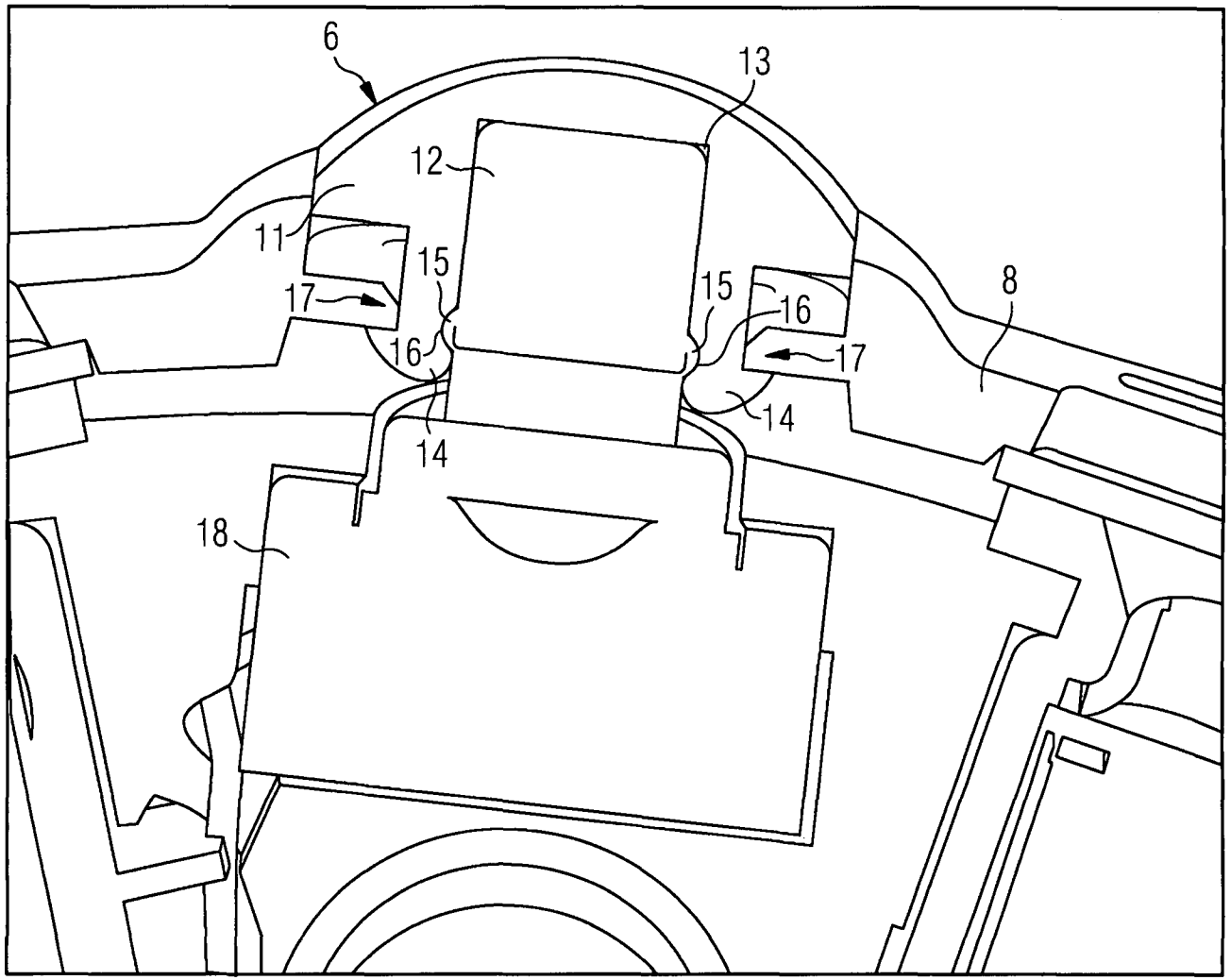
FIG. 4: shows a sectional view of a pushbutton

FIG. 4 shows a detailed view of the pushbutton 6 in FIG. 3. A pushbutton 6 comprising a probe 11 and a locking element 12 are shown in a sectional view. The locking element 12 is inserted into a cavity 13 of the probe 11. The two bulges 16 of the locking element 12 form a snap-on connection together with the grooves 16 of the probe. The bulges 15 press two snap-on hooks 14 of the probe 11 outwards and thus form an additional snap-on connection. The pushbutton 6 is fastened to the housing shell 8 using this additional snap-on connection. Locking projections 17 in the form of an undercut of the housing upper part 8, together with the snap-on hook 14 of the probe 11, form the snap-on connection.

A button 18, for instance an on/off switch of the hearing device, is attached below the locking element 12. By actuating the probe 11, the locking element 12 is pushed against the button 18. As a result, a switching process is introduced with the button 18. These constructional measures allow the installation size of the button 18 and the probe 11 to be independent of one another. The surface of the probe 11 can thus comprise an operator-friendly large pressure surface.

Figure 5:
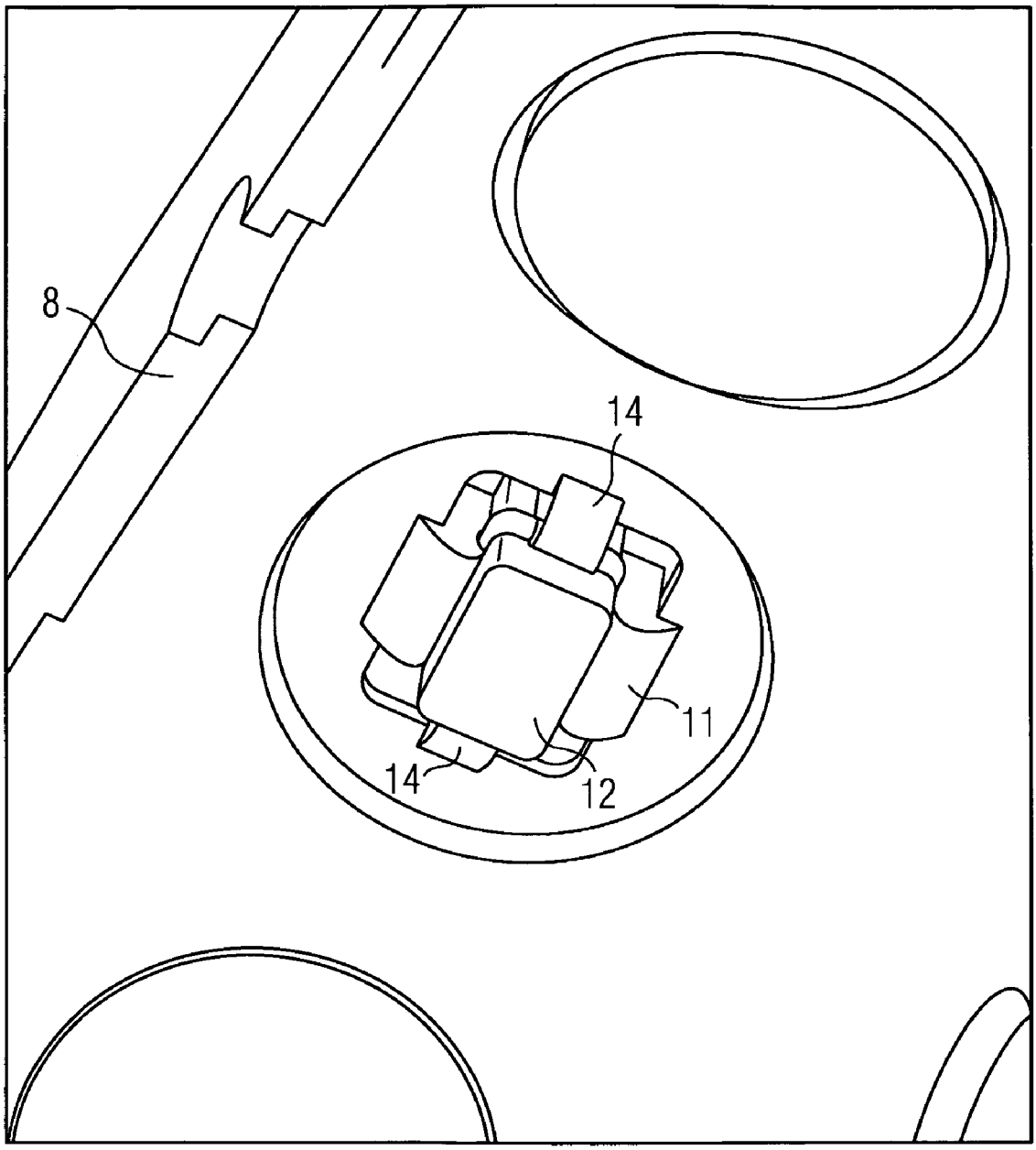
FIG. 5: shows a view of the pushbutton from below.

FIG. 5 shows the housing shell 8 with an incorporated pushbutton 6 from below. The pushbutton 6 consists of a probe 11 and a locking element 12. Two snap-on hooks 14 fix the probe 11 into the housing shell 8. The locking element 12 inserted into a cavity of the probe 11 causes the snap-on hook 14 to lock onto the housing shell 8.

The invention claimed is:

1. A pushbutton for a hearing device, comprising:
a locking element; and
a probe moveably mounted in an opening of a housing shell in the hearing device, the probe having a cavity in the direction of an interior of the housing shell, wherein insertion of the locking element into the cavity effects a first snap-on connection between the locking element and the probe and causes a simultaneous second snap-on connection between the probe and the housing shell.

2. The pushbutton as claimed in claim 1,
wherein the probe includes a snap-on hook, and
wherein the second snap-on connection is formed by at least the snap-on hook such that the locking element locks the snap-on hook to the housing shell.

3. The pushbutton as claimed in claim 2, wherein the first snap-on connection is formed by at least a bulge on the locking element.

4. The pushbutton as claimed in claim 2, wherein the snap-on hook engages on a the a recess or an undercut of the housing shell.

5. The pushbutton as claimed in claim 1, wherein a button is arranged under the locking element in the hearing device such that the locking element actuates the button when the probe is pressed in.

6. The pushbutton as claimed in claim 5, wherein the button moves to counter a force, with a switching stage being tactually feelable when the probe is pushed in.

7. The pushbutton as claimed in claim 6, wherein the button is fastened to a frame of the hearing device.

8. A behind-the-ear hearing device, comprising:
a housing shell;
a pushbutton for a hearing device, comprising:
a locking element, and
a probe moveably mounted in an opening of the housing shell, the probe having a cavity in the direction of an interior of the housing shell, wherein insertion of the locking element into the cavity effects a first snap-on connection between the locking element and the probe and causes a simultaneous second snap-on connection between the probe and the housing shell; and
a button arranged under the locking element such that the locking element actuates the button when the probe is pressed in.

9. The behind-the-ear hearing device as claimed in 8,
wherein the probe includes a snap-on hook, and
wherein the second snap-on connection is formed by at least the snap-on hook such that the locking element locks the snap-on hook to the housing shell.

10. The behind-the-ear hearing device as claimed in claim 8, wherein the snap-on hook engages on a recess or an undercut of the housing shell.

11. The behind-the-ear hearing device as claimed in 8,
wherein the probe includes a snap-on hook, and
wherein the second snap-on connection is formed by at least the snap-on hook such that the locking element locks the snap-on hook to the housing shell.

12. The behind-the-ear hearing device as claimed in claim 11, wherein the snap-on hook engages on a recess or an undercut of the housing shell.

13. The behind-the-ear hearing device as claimed in claim 12, wherein the snap-on hook engages on a recess or an undercut of the housing shell.

14. The behind-the-ear hearing device as claimed in claim 8, wherein the first snap-on connection is formed by at least a bulge on the locking element.

15. The behind-the-ear hearing device as claimed in claim 8, wherein the button is moved counter to a force, with a switching stage being tactually feelable when the probe is pushed in.

16. The behind-the-ear hearing device as claimed in claim 8, the button is fastened to a frame of the hearing device.

* * * * *